United States Patent [19]

Simm et al.

[11] 4,454,627

[45] Jun. 19, 1984

[54] DEVICE FOR CLEANING TEXTILE SURFACES

[75] Inventors: Hans-Peter Simm, Wuppertal; Wieland Gühne, Remscheid; Christoph Hoesch, Essen; Renate Friedrichs, Wuppertal, all of Fed. Rep. of Germany

[73] Assignee: Vorwerk & Co. Interholding GmbH, Wuppertal, Fed. Rep. of Germany

[21] Appl. No.: 321,896

[22] Filed: Nov. 16, 1981

[30] Foreign Application Priority Data

Dec. 2, 1980 [DE] Fed. Rep. of Germany ..... 3045392

[51] Int. Cl.[3] ..... A47L 5/26

[52] U.S. Cl. ..... 15/377; 15/344; 15/381; 15/413; 15/416

[58] Field of Search ..... 15/344, 377, 381, 413, 15/416

[56] References Cited

U.S. PATENT DOCUMENTS

| | | | |
|---|---|---|---|
| 1,470,894 | 10/1923 | Throop | 15/416 X |
| 2,202,989 | 6/1940 | Kitto | 15/377 X |
| 2,309,583 | 1/1943 | Frantz | 15/413 X |
| 3,060,485 | 10/1962 | Butter et al. | 15/413 X |

FOREIGN PATENT DOCUMENTS

| | | | |
|---|---|---|---|
| 109854 | 4/1925 | Fed. Rep. of Germany | 15/416 |

*Primary Examiner*—Chris K. Moore

*Attorney, Agent, or Firm*—Michael J. Striker

[57] ABSTRACT

A cleaning device operated in conjunction with a vacuum cleaner includes a housing which is composed of a motor housing accommodating a drive motor, a removable nozzle plate formed with a first individual nozzle and a second surface nozzle and enclosing a working tool with a brush, and an air-duct housing forming a suction duct connectable to the vacuum cleaner.

4 Claims, 3 Drawing Figures

DEVICE FOR CLEANING TEXTILE SURFACES

BACKGROUND OF THE INVENTION

This invention pertains to a cleaning device for cleaning textile surfaces which may be utilized in conjunction with a vacuum cleaner. More particularly, the invention relates to a device with an electrically driven machining tool and a housing having a suction duct connectable to the vacuum cleaner.

Various devices for cleaning textile surfaces are known in the art. These devices are furnished with an electromotor which activates a rotary brush which performs cleaning of textile surfaces. These devices, however, have certain disadvantages.

Rotatable brushes, such as rollers or discs, in operation pass the nap of the textile only superficially so that cleaning carried out by conventional devices is not sufficiently intensive. Furthermore, such known devices equipped wih roller brushes are relatively high for convenient handling.

Additional arrangements are required in the prior art cleaning devices for removal of cleaning means therefrom. The devices therefore are provided with a suction motor which is not used during cleaning.

SUMMARY OF THE INVENTION

It is an object of the invention to provide a cleaning device which avoids the disadvantages of the prior art.

Another object of the invention is to provide an improved device for cleaning textile surfaces.

Still another object of the invention is to provide a cleaning device which may perform two functions: suction and cleaning and may be used in conjunction with a vacuum cleaner.

Yet another object of the invention is to provide a cleaning device which is easy to manipulate.

These and other objects of the invention are attained by a device for cleaning textile surface, in conjunction with a vacuum cleaner, comprising an electrically driven working tool, an electromotor and a transmission means connected thereto for driving said working tool, said working tool being adapted for oscillating pivoting movement, a housing, said housing including a drive motor casing accommodating the motor and the transmission, a nozzle plate housing accommodating said working tool and formed with a connection nozzle and a surface nozzle, an air-duct casing, and a connection support connected to the air-duct casing and connectable to the vacuum cleaner.

The nozzle plate housing and the working tool are detachable from the overall housing to facilitate cleaning of the device.

The nozzle plate housing may be formed with a first suction channel communicating with said connection nozzle and a second suction channel communicating with said surface nozzle, the first suction channel and the second suction channel being selectively open into said connection support.

A grip may be mounted on the connection support.

The working tool may be formed with a projecting tip, said nozzle plate housing including two projections spaced from each other to form a gap therebetween, said tip being positioned in said gap.

The nozzle plate housing has a lower surface, and the drive motor casing has a lower surface, the lower surface of said drive motor casing extending above said lower surface of said nozzle plate housing.

The drive motor casing may be provided with openings for motor cooling, which are formed in the wall facing the connection support.

The air-duct casing may be provided with a gripping surface.

The basic advantage of the cleaning device according to the invention is that the device may be used for suction and for cleaning thus providing an intensive cleaning action and may be easily cleaned itself due to its special construction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAIL DESCRIPTION OF THE PREFERRED EMBODIMENTS

Figure 1:
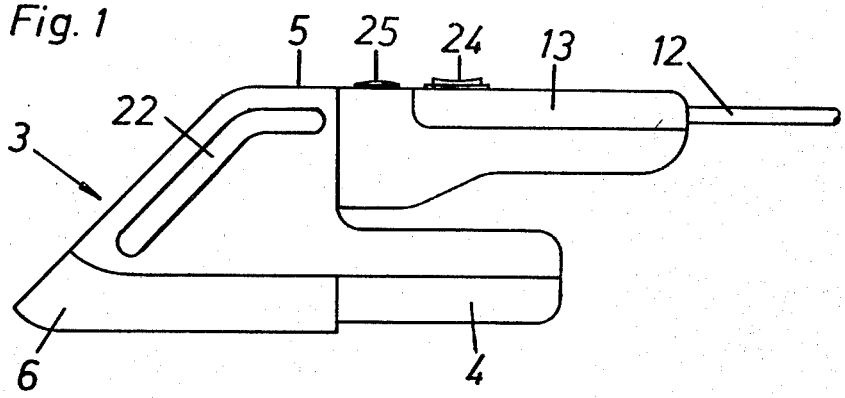
FIG. 1 is a side view of a cleaning device of the invention, with a grip and electrical cord.

With reference to the drawings, FIG. 1 depicts a device for cleaning textile surfaces. The device comprises a housing 3 which is composed of a drive motor casing 4, air-duct casing 5 and nozzle element 6. The housing 3 includes a connection support 10 (FIG. 3) with a grip 13 attached thereto. Grip 13 serves for handling the device and for accommodating the end of an electric conductor 12 for supplying the device with electric power. In order to turn the device on or off a switch 24 is provided in a conventional manner on the grip 13. Grip 13 may be easily removed form the housing by pushing a button 25.

The air-duct casing 5 is additionally provided with a gripping surface or depression 22 which further facilitates the manipulation of the device.

Figure 2:
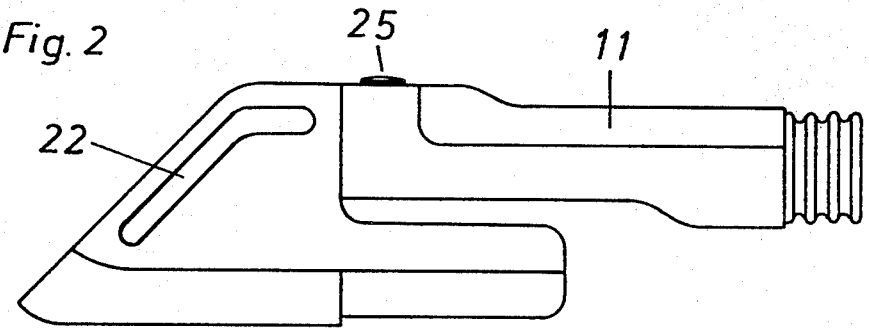
FIG. 2 is a side view of a cleaning device of the invention, with a suction duct to be connected to a vacuum cleaner.
Figure 3:
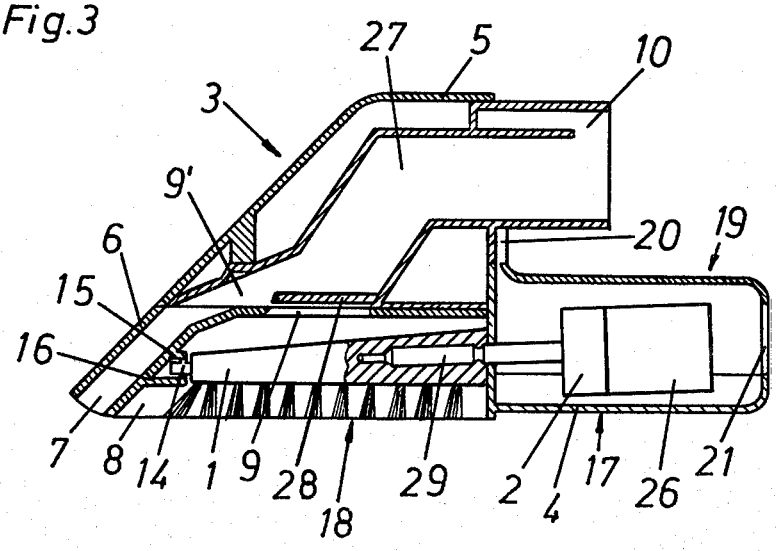
FIG. 3 is a sectional view through the cleaning device illustrated in FIG. 1.

FIG. 2 illustrates the cleaning device similar to that of FIG. 1 but provided with a suction duct 11 in a connection support 10 (which is shown in FIG. 3). The suction duct 11 can be provided with the electrical conductor 12 which can be connected integrally therewith. Suction duct 11 can be detached from the housing 3 by pushing the button 25. In this embodiment the air-duct casing 5 can also be formed with the gripping surface 22.

Referring now to FIG. 3, the overall housing 3 of the cleaning device includes air-duct casing 5, drive motor casing 4 and nozzle element 6. Nozzle element 6 encloses a working tool 1 carrying a brush at the lower surface thereof.

The air-duct casing 5 combines switchable suction passages 9 and 9' which may be selectively open into the opening of the connection support 10. The connection support 10 may be provided with a conventional means (not illustrated herein) which supply electric power to the device in addition to an electromotor 26.

As seen in FIG. 3 a flap or shutter 28 is disposed in a suction channel 27. Shutter 28 can be moved or turned by any suitable conventional means so as to open or close communication between channel 27 and passages 9 and 9', respectively. Shutter 28 selectively opens or closes passages 9 and 9' in order to communicate either of them with the channel 27 depending on the requirement of the operation of a joint individual nozzle 7 or surface working tool 1 having a surface nozzle 8.

Below the connection support 10 the drive motor casing 4 is located with accommodates the electric motor 26, transmission 2 and output shaft 29 carrying the tool 1.

The outer wall 19 of the motor casing 4 which faces connection support 10 is made with openings 20 and 21 for motor cooling. For convenient manipulation of the device the lower surface 17 of the motor casing is formed higher than the lower surface 18 of the nozzle element 6.

The drive motor casing 4 surrounds the electromotor 26 which is coupled with the transmission device 2 which serves for imparting an oscillating pivoting movement to the operating tool 1. The operating tool 1 is detachably rigidly connected to the shaft 29. If desired the operating tool may be withdrawn from the housing 3 by drawing the nozzle element 6 out of the housing. Because the housing 3 is made of easily removable parts, the joint nozzle 7 or surface nozzle 8 can be easily cleaned if clogging occurs in either of those nozzles.

In the assembled position, a tip 14 of the working tool is disposed in a space formed between two projections 15, 16 provided on the inner surface of the nozzle element 6. This protects the working tool from buckling.

It will be understood that each of the elements described above, or two or more together, may also find a useful application in other types of cleaning devices, differing from the types described above.

While the invention has been illustrated and described as embodied in a cleaning device, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a device for cleaning textile surfaces operable in conjunction with a vacumm cleaner, a combination comprising an electrically driven working tool; an electromotor having an output shaft connected to said working tool to provide for oscillating pivotal movement of the working tool relative to a surface to be cleaned and a housing including a drive motor casing, a nozzle casing and an air-duct casing, said nozzle casing being formed with a first nozzle and a second nozzle, said second nozzle accommodating said working tool, said air-duct casing including a connection element having a suction duct connectable to the inlet of the vacuum cleaner fan, said nozzle casing being formed with a first suction channel communicating with said first nozzle and a second suction channel communicating with said second nozzle, said first suction channel and said second suction channel being selectively open into said suction duct, and said connection element being a grip, said working tool being formed with a projecting tip, said nozzle housing including two projections spaced from each other to form a gap therebetween, said tip being positioned in said gap to provide an axis about which said pivotal movement occurs.

2. The device of claim 1, said nozzle housing having a lower surface, said drive motor casing having a lower surface, the lower surface of said drive motor casing extending above said lower surface of said nozzle housing.

3. The device of claim 2, wherein said drive motor casing is provided with openings for motor cooling.

4. The device of claim 3, said drive motor casing having a wall facing said connection element, at least one of said openings being formed in said wall.

* * * * *